US007144300B1

(12) United States Patent
Cybulski et al.

(10) Patent No.: US 7,144,300 B1
(45) Date of Patent: Dec. 5, 2006

(54) SANDING TOOL WITH CLAMPING MECHANISM

(75) Inventors: Eric R. Cybulski, Woodbury, MN (US); Ryan Patrick Simmers, Cottage Grove, MN (US); Jon A. Kirschhoffer, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/275,390

(22) Filed: Dec. 29, 2005

(51) Int. Cl.
*B24B 23/00* (2006.01)

(52) U.S. Cl. ..... 451/28; 451/354; 451/523; 451/525

(58) Field of Classification Search ..... 451/28, 451/344, 354, 356, 509, 523–525, 557, 559, 451/365, 515
See application file for complete search history.

(56) References Cited

U.S. PATENT DOCUMENTS 5,168,672 A 12/1992 Gregoire, Sr.
5,863,243 A * 1/1999 Ali ..... 451/503
5,926,896 A * 7/1999 Allemann et al. ..... 15/147.2
6,613,113 B1 9/2003 Minick et al.
6,626,746 B1 * 9/2003 Mayr et al. ..... 451/356
6,641,469 B1 * 11/2003 Deshler ..... 451/514
6,755,727 B1 * 6/2004 Bjerkhoel ..... 451/513
6,935,936 B1 * 8/2005 Goulet et al. ..... 451/344
2003/0104777 A1 6/2003 Deshler

* cited by examiner

*Primary Examiner*—Lee D. Wilson
*Assistant Examiner*—Anthony Ojini
(74) *Attorney, Agent, or Firm*—David B. Patchett

(57) ABSTRACT

A hand-held, manually-operated sanding tool for use with a replaceable sheet of abrasive material includes a base member and a clamping mechanism. The base member defines first and second ends, a bottom surface extending between the first and second ends, a contact surface formed opposite the bottom surface and extending from the first end, and at least one tooth extending from the contact surface. The clamping mechanism is pivotally connected to the base member at a pivot point, defines a front section opposite the pivot point, and is movable about the pivot point between an open position, in which the front section is spaced from the contact surface for receiving an end portion of a sheet of abrasive material, and a closed position, in which the clamping mechanism is more proximate the contact surface and the front section is more proximate the at least one tooth.

20 Claims, 5 Drawing Sheets

SANDING TOOL WITH CLAMPING MECHANISM

CROSS-REFERENCE TO RELATED APPLICATIONS

This application is related to U.S. patent application Ser. No. 11/117,982, filed Apr. 29, 2005, entitled "Sanding Tool;" Ser. No. 11/201,742, filed Aug. 11, 2005, entitled "Sanding Tool with Rotatable Handle;" Ser. No. 11/201,763, filed Aug. 11, 2005, entitled "Sanding Tool with Sheet Loading Feature;" Ser. No. 11/201,743, filed Aug. 11, 2005, entitled "Sanding Tool with Protective Clamping Mechanism;" and Ser. No. 11/275,396, filed on even date herewith, entitled "Sanding Tool with Rotatable Handle"; the teachings all of which are incorporated herein by reference.

BACKGROUND

The present invention relates generally to hand-held, manually-operated sanding tools for use with a replaceable sheet of abrasive material such as sandpaper. More particularly, it relates to sanding tools that are easy to load and related methods of use.

Abrasive sheets, such as conventional sandpaper, are commonly used to hand-sand or finish a work surface, such as a wooden surface. With hand-sanding, the user holds the sandpaper directly in his/her hand and then moves the sandpaper across the work surface. Sanding by hand can, of course, be an arduous task. To facilitate the hand-sanding process, the sandpaper can instead be retained by a sanding block or tool sized to fit within the user's hand. The sanding block or tool thus makes hand-sanding faster and easier. One example of a commercially-available sanding block is the 3M™ Rubber Sanding Block available from 3M Company of Saint Paul, Minn.

U.S. Pat. No. 5,168,672 describes another exemplary sanding block or tool in the form of an abrasive sheet holder having a base provided with clamping shoulders formed in a pair of opposed side edges thereof. A handle is detachably secured over a rear surface of the base. The handle has opposed flexible flange walls for clamping opposed end edge portions of an abrasive paper sheet that is otherwise positioned over a front working surface of the base, with the edge portions of the paper sheet extending over the clamping shoulders.

Additionally, U.S. Patent Application Publication No. 2003/0104777 describes a sanding block or tool including a generally rectangular base housing upon which a multi-contoured, generally convex hand-grip is secured. The hand-grip further defines inwardly extending concave portions that facilitate easy and secure grasping by the user. Further, an over-center lever clamp mechanism is operative at each end of the sanding block to secure the opposed ends of a sandpaper sheet in a releasable manner.

While well-accepted, known sanding blocks may have certain shortcomings. For example, it is desirable that the sheet of abrasive material be tensioned or tightly fit about the sanding block. If the sheet is not tight, it may wrinkle, and the wrinkles may snag on the work surface and cause the abrasive sheet to tear. In addition, wrinkles may cause the work surface to be damaged or sanded unevenly. These concerns arise with flexible flat sheets of abrasive material, such as conventional sandpaper, as well as with resilient flexible abrasive sheets that are thicker than conventional sandpaper, such as the sheet-like abrasive materials described in, for example, Minick et al., U.S. Pat. No. 6,613,113. Unfortunately, the mechanisms by which conventional sanding blocks or tools effectuate loading of the abrasive sheet do not consistently achieve the desired, tensioned fit.

In particular, the common technique by which known sanding blocks are loaded with an abrasive sheet generally entails securing opposing ends of the abrasive sheet to opposite sides of the sanding block. With one approach, a user attempts to simultaneously secure the opposing ends of the abrasive sheet to the sanding block while at the same time tensioning the abrasive sheet. This requires considerable dexterity, and often times the user is unable to achieve satisfactory results. Alternatively, the user can sequentially mount a first end portion of the abrasive sheet to one side of the sanding block, wrap the abrasive sheet about a bottom of the sanding block, and then secure the second end portion of the sheet to the opposite side of sanding block. A tension is theoretically created and maintained while wrapping the sheet about the bottom. While this technique is physically easier to perform, it can be equally frustrating for the user. Namely, it is difficult at best to properly estimate the amount (i.e., length) of the first end portion of the abrasive sheet to initially secure to the first side of the sanding block such that when the abrasive sheet is wrapped about the bottom, a proper length remains for securement to the opposing side of the sanding block. For example, if an excessive length of the abrasive sheet is initially secured to the sanding block, there may not be a sufficient length remaining to wrap about the sanding block and secure to the opposing side thereof. Conversely, if too short a length of the abrasive sheet is initially secured to the sanding block, it may be problematic to secure the second end to the opposing side of the sanding block as the excessive, remaining length that interferes with proper functioning of the securement mechanism; similarly, it may be impossible to achieve desired tensioning of the abrasive sheet, again due to the excessive remaining length. In either case, the user is required to release the first end from the sanding block and try again. Clearly, this can be frustrating for the user.

In light of the above, a need exists for a sanding tool that is easy to consistently and satisfactorily load with a sheet of abrasive material in a manner that tightly secures the abrasive sheet.

SUMMARY

Aspects of the present invention relate to a hand-held, manually-operated sanding tool for use with a replaceable sheet of abrasive material. The sanding tool includes a base member and a clamping mechanism. The base member defines first and second ends, a bottom surface extending between the first and second ends, a contact surface formed opposite the bottom surface and extending from the first end, and at least one tooth extending from the contact surface. The clamping mechanism is pivotally connected to the base member at a pivot point. The clamping mechanism defines a front section opposite the pivot point and is movable about the pivot point between an open position and a closed position. In the open position, the front section is spaced from the contact surface to establish a gap between the clamping mechanism and the contact surface for receiving an end portion of a sheet of abrasive material. In the closed position, the clamping mechanism is more proximate the contact surface and the front section is more proximate the at least one tooth than when the clamping mechanism is in the open position.

DETAILED DESCRIPTION

Figure 1:
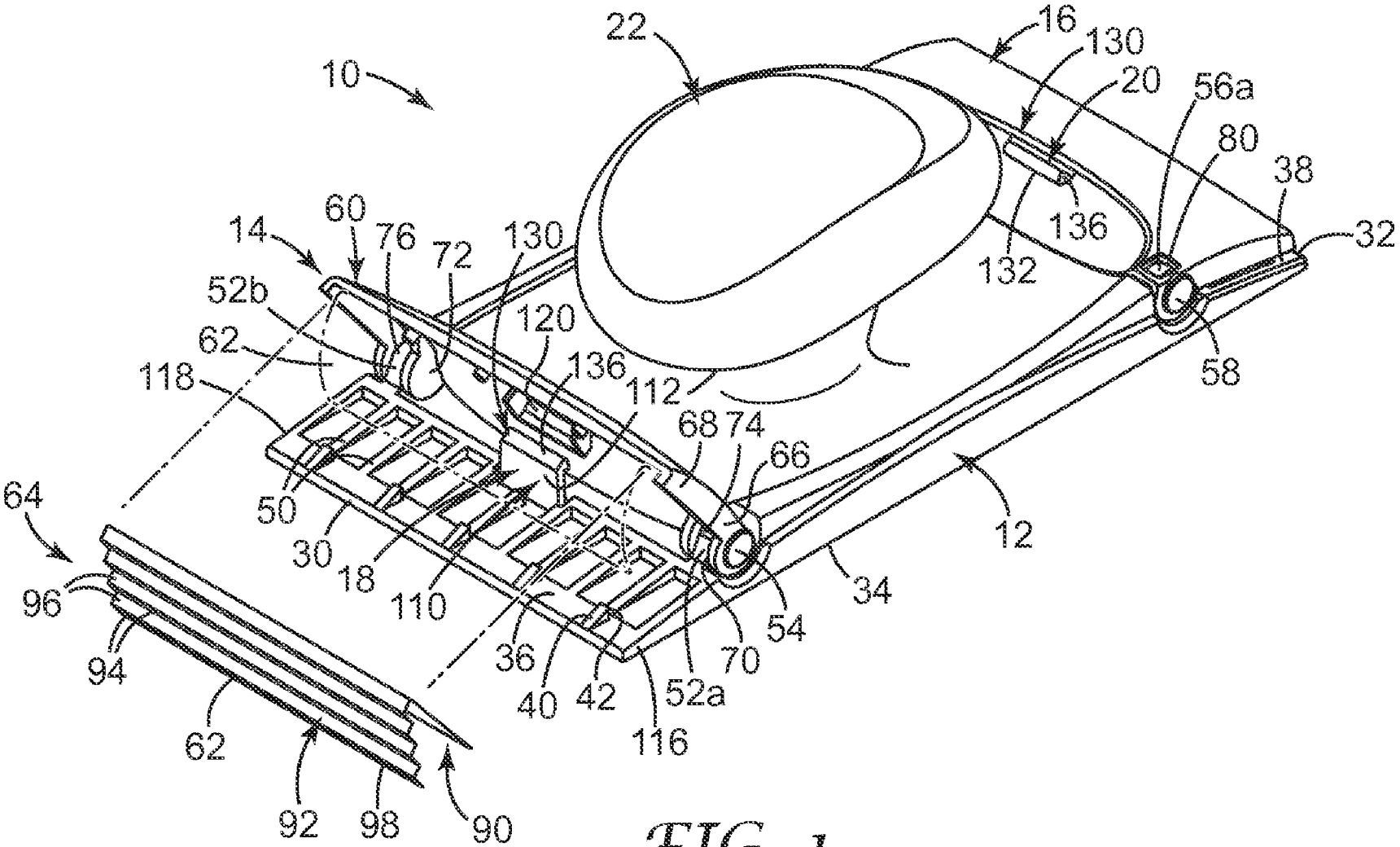
FIG. 1 is a perspective, partially-exploded view of a hand-held, manually-operated sanding tool according to principles of the present invention.

One embodiment of a hand-held, manually-operated sanding tool or sanding block 10 is shown in FIG. 1. The term "manually-operated" refers to the fact that the tool 10 is not a power tool. That is, all of the power for the tool 10 is provided by a user (not shown), and the tool 10 itself does not include a motor. It will be recognized, however, that principles of the present invention may be applied to a power tool and are not necessarily limited to manually-operated sanding tools.

The sanding tool 10 is described below as being useful with sheet-like abrasive material. As used throughout this specification, the terms "sheet-like abrasive material" and "sheet of abrasive material" are used interchangeably and refer to thin, flexible, generally square or rectangular sheets of abrasive material having discrete ends (or edges) that can be attached to a sanding block. Such sheet-like abrasive materials include, for example, conventional sandpaper, flexible sanding scrims, non-woven abrasive materials such as Scotch-Brite™ available from 3M Company, St. Paul, Minn., and thin flexible abrasive sheet materials such as those described in U.S. Pat. No. 6,613,113 (Minick et al.), the entire contents of which are hereby incorporated by reference. The tool 10 may also find use with non-abrasive sheet-like materials such as dust removing tack cloths. However, the terms "sheet-like abrasive material" and "sheet of abrasive material" do not include so-called endless belts of abrasive material commonly used with power sanding tools, die cut sheets for power detail sanding tools, or abrasive sheets having their own attachment means, such as adhesive or hook-and-loop fasteners, that independently facilitate attachment to a tool.

With the above in mind, in one embodiment, the sanding tool 10 includes a base member 12, first and second clamping mechanisms 14, 16, and first and second alignment devices 18, 20. In some embodiments, the sanding tool 10 further optionally includes a handle 22. As made clear below, the base member 12, the clamping mechanism(s) 14 and/or 16, and the alignment device(s) 18 and/or 20 can assume a wide variety of forms apart from that shown in FIG. 1 in accordance with the principles of the present invention. Regardless, and in general terms, the first and second clamping mechanisms 14, 16 are pivotally associated with opposing ends, respectively, of the base member 12. The first alignment device 18 extends at least partially between the base member 12 and the first clamping mechanism 14, whereas the second alignment device 20 extends at least partially between the base member 12 and the second clamping mechanism 16. During use, and as described in greater detail below, the first and second alignment devices 18, 20 promote consistent loading of a sheet of abrasive material (not shown) with the clamping mechanisms 14, 16 in a simplified manner.

In one embodiment, the base member 12 defines first and second opposed ends 30, 32, and a generally planar bottom surface 34 against which a sheet of abrasive material (not shown) extends. While the base member 12 is illustrated in FIG. 1 as having a generally rectangular shape, a variety of other shapes can be provided that lend themselves for use with conventional sheet-like abrasive materials. For example, the base member 12 can be configured such that one or both of the first and second ends 30, 32 define a triangular or curved shape. Further, the first and second ends 30, 32 need not be identical in shape.

In one embodiment, regardless of an overall shape, the base member 12 forms a first upper contact surface 36 opposite the bottom surface 34 and extending from the first end 30. Though substantially hidden in FIG. 1, a second upper contact surface 38 (referenced generally) is similarly formed opposite the bottom surface 34, extending from the second end 32. In one embodiment, the upper contact surfaces 36, 38 are angled or inclined. In this manner, the upper contact surfaces 36, 38 and the bottom surface 34 form an acute angle relative to the associated end 30, 32, respectively. In the illustrated embodiment, the contact surfaces 36, 38 are defined by the exposed upper surfaces of a plurality of spaced ribs 50 (shown for the first contact surface 36 in FIG. 1). With this one configuration, the contact surface area between the sheet-like abrasive material (not shown) and the associated contact surface 36 or 38 is decreased (as compared to a continuous surface), thereby allowing the sheet to slide upwardly along the respective contact surfaces 36, 38 more readily to tension the sheet-like abrasive material as described below. Alternatively, the first and/or second contact surfaces 36 and/or 38 can be defined in a variety of other manners, need not be identical and need not necessarily be angled or inclined relative to the bottom surface 34.

In one embodiment, one or more teeth 40 extend from each of the contact surfaces 36, 38 upwardly (relative to the orientation of FIG. 1). The teeth 40 extending from the contact surfaces 36, 38 are linearly aligned and laterally spaced (relative to a length of the base member 12) along the respective contact surface 36 or 38. In one embodiment, each of the teeth 40 is positioned at or near the respective end 30 or 32 to prevent or decrease the likelihood that each tooth 40 will substantially interfere with movement of the sheet-like abrasive material (not shown) movement upwardly along the respective contact surface 36, 38 during loading as described above and as will be further described below. In one configuration, each tooth 40 may laterally be positioned to align with one of the plurality of spaced ribs 50. Alternatively, a single tooth 40 extends along an entire width of or a smaller portion of the width of the first end 30 of base member 12. In one embodiment, each tooth 40 is formed as a ramp extending increasingly upwardly (i.e., increased height) from the contact surface 36, 38 as the tooth 40 extends away from the respective end 30 or 32. Accordingly, each tooth 40 defines a point 42 opposite the respective contact surface 36 or 38.

As described below, the base member 12 is configured to facilitate pivoting or rotational attachment thereto by the first and second clamping mechanisms 14, 16. For example, in one embodiment, the base member 12 forms a pair of posts 52*a*, 52*b* adjacent the first contact surface 36 opposite the first end 30. The posts 52*a*, 52*b* are laterally aligned (relative to a length of the base member 12) and are configured to receive a corresponding component associated with the first clamping mechanism 14 in a manner allowing for rotation of the first clamping mechanism 14 relative to the posts 52*a*, 52*b*. A wide variety of other structure(s) and/or mechanisms can be provided for rotatably connecting the first clamping mechanism 14 to the base member 12. Regardless, a pivot point 54 (referenced generally) is established by the base member 12 about which the first clamping mechanism 14 rotates or pivots. In one embodiment in which the first and second clamping mechanisms 14, 16 are similarly constructed, the base member 12 forms a second set of posts 56*a*, 56*b* (it being understood that the post 56*a* is partially illustrated in FIG. 1 and the post 56*b* is hidden) for rotatably receiving corresponding features of the second clamping mechanism 16. Once again, a pivot point 58 is established, and a wide variety of other configurations can be used in place of the posts 56*a*, 56*b*. Even further, in alternative embodiments, the second clamping mechanism 16 is not substantially similar to the first clamping mechanism 14 and/or is replaced with a conventional mechanism for securing the sheet-like abrasive material to the second end 32 of the base member 12, such that the posts 56 can be eliminated.

In one embodiment, the first and second clamping mechanism 14, 16 are identical. Thus, the following description of the first clamping mechanism 14 applies equally to the second clamping mechanism 16 and vice versa, it being understood that with other embodiments, the second clamping mechanism 16 has a different construction than the first clamping mechanism 16 and/or can be replaced, for example, with a conventional sheet securement mechanism. With this in mind, the clamping mechanism 14 includes a pivoting member 60 and a gripping surface 62 (shown with phantom lines of FIG. 1) provided by, as illustrated in the embodiment of FIG. 1, a tensioning member 64 (it being understood that the tensioning member 64 is illustrated apart from the pivoting member 60 in FIG. 1 for clarity). The pivoting member 60 and the tensioning member 64 can assume a wide variety of forms varying from that shown in FIG. 1. In general terms, however, the pivoting member 60 forms a mounting section 66 (referenced generally) and a front section 68 (referenced generally). The mounting section 66 is configured for pivotable or rotatable connection to the base member 12. Upon final assembly, the gripping surface 62 extends from the front section 68.

In one embodiment, the pivoting member 60 is an integral or unitary body, with the mounting section 66 including first and second pairs 70, 72 of legs, each defining a slot 74, 76 (referenced generally). The slots 74, 76 are sized to receive a corresponding one of the posts 52*a*, 52*b* provided with the base member 12 such that the corresponding pair of legs 70, 72 are rotatably secured to the posts 52*a*, 52*b*, respectively, upon final assembly. Alternatively, and as mentioned above, the pivoting member 60 can be configured to include a variety of other structure(s) and/or mechanisms adapted to facilitate rotatable or pivotable connection of the pivoting member 60 to the base member 12.

Figure 2:
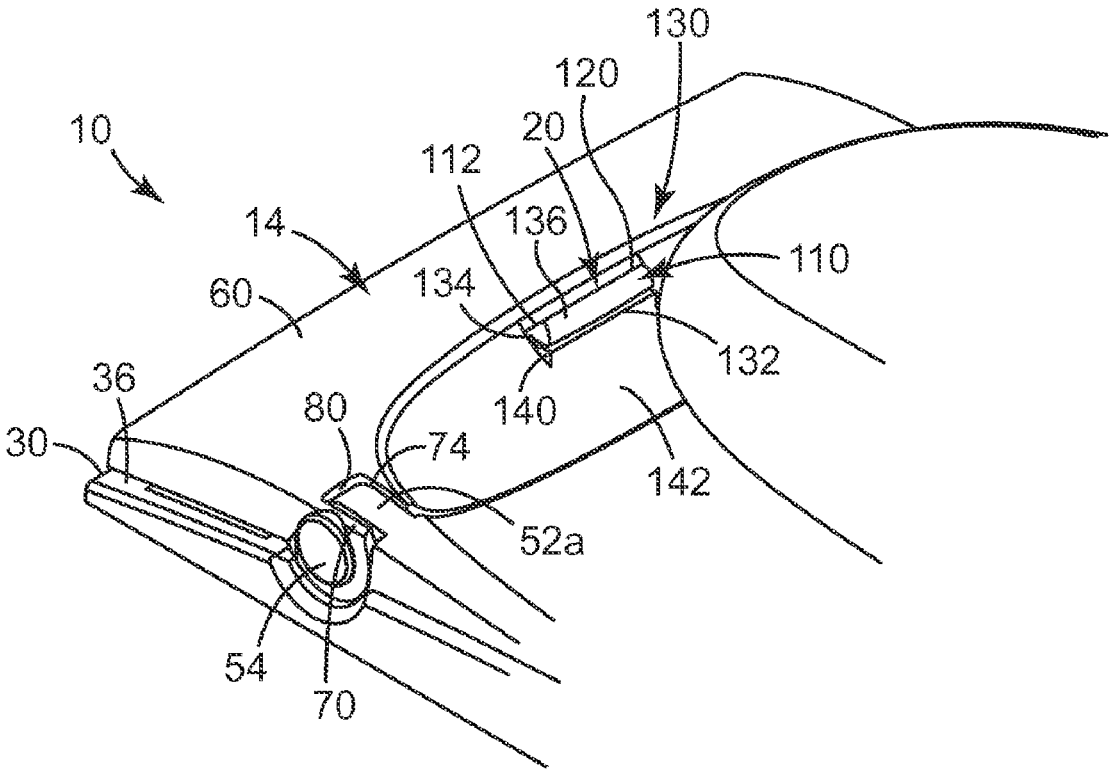
FIG. 2 is a perspective view of a portion of the sanding tool of FIG. 1.
Figure 3:
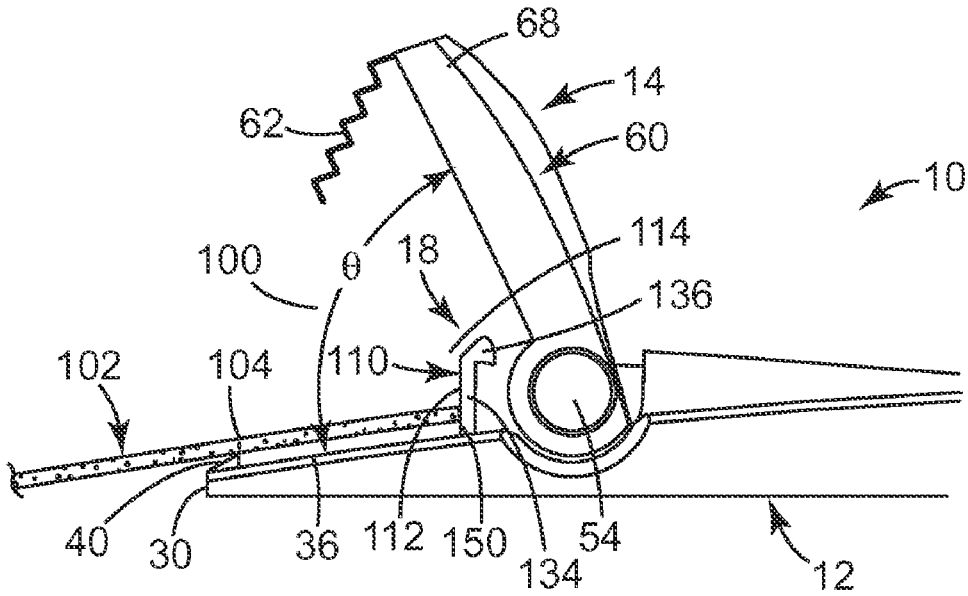
FIG. 3 is a side view of a portion of the sanding tool of FIG. 1, illustrating initial loading of a sheet-like abrasive material.

As illustrated in FIG. 2, in one example, the slot 74 is further defined by a transverse surface 80 extending between the pair of legs 70 nearest the first end 30 (it being understood that a similar transverse surface (unnumbered) is provided with the slot 76). In one embodiment, the pair of legs 70 extends from the transverse surface 80 to form the slot 74 with no other transverse members extending between the pair of legs 70. As such, the slot 74 is formed to be substantially U-shape to rotatably receive the post 52*a* upon assembly. The lack of transverse members between the legs 70 other than the surface 80 permits the pivoting member 60 to opened in a wide manner (i.e., to be pivoted further away from the contact surface 36). More specifically, as illustrated in FIG. 3, the pivoting member 60 opens to define an angle θ between the pivoting the first contact surface 36 and the pivoting member 60. In one embodiment, the angle θ is greater than or equal to 60°, more preferably, is greater than or equal to 80°.

Once again referring to FIG. 1, in one embodiment, the tensioning member 64 is a thin flexible strip of metal, for example, forming a leaf spring-like configuration, that generally returns to the orientation shown in FIG. 1. Alternatively, the tensioning member 64 can be formed of other materials, such as plastic(s), film(s), etc. In one embodiment, the tensioning member 64 includes a support wall 90 and a gripping wall 92. The support wall 90 is configured for attachment to the pivoting member 60. The gripping wall 92 extends from the support wall 90 and defines the gripping surface 62. Upon final assembly, the gripping wall 92, and thus the gripping surface 62, extends generally inwardly (i.e., toward the contact surface 36) from the front section 68 of the pivoting member 60.

In one embodiment, as illustrated in FIG. 1, the gripping wall 92 and the gripping surface 62 are each formed with a stair-like or stepped configuration. More specifically, gripping wall 92 includes a plurality of bends 94 in alternating directions, which extend laterally across an entire width of the gripping wall 92 to define a plurality of steps 96. Alternatively, at least some of the bends 94, and in particular, one or more of the bends 94, can extend across less than an entire width of the gripping wall 92 and/or can be intermittent. In addition, while the bends 94 are illustrated as being approximately equidistantly spaced relative to a length of the gripping wall 92, other, more random or other suitable spacings are equally acceptable. In one embodiment, a width of the gripping wall 92 tapers adjacent a free edge 98 of the gripping wall 92 opposite the support wall 90. Alternatively, a width of the gripping wall 92 can be uniform or otherwise vary from that shown in FIG. 1. Regardless, in one embodiment, at least the first bend 94 is substantially parallel with the free edge 98. Alternatively, the gripping surface 62 can be provided with a variety of other configurations, such as with a smooth, pitted, or other suitable gripping surface 62. For example, the tensioning member 64, and in particular the gripping wall 92, can assume a variety of other forms varying from that shown in FIG. 1. Even further, the gripping surface 62 can be provided as an integral, unitary portion of the pivoting member 60.

Figure 4:
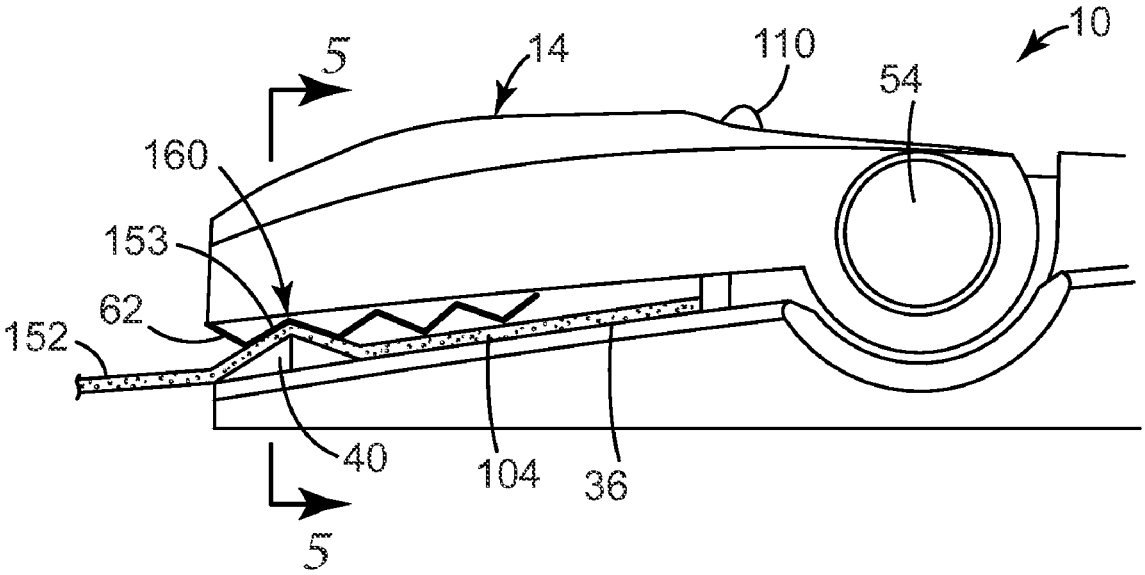
FIG. 4 is a side view of a portion of FIG. 3 with the clamping mechanism in a closed position.

Upon final assembly, and with additional reference FIGS. 2–4, the first clamping mechanism 14 is rotatably connected to the base member 12. This construction allows the first clamping mechanism 14 to pivot (at the pivot point 54) between an open position as shown in FIG. 3 and a closed position as shown in FIG. 4 (also shown for the second clamping mechanism 16 in FIG. 1). In the open position, the front section 68 of the pivoting member 60 is spaced from the first contact surface 36, establishing a gap 100 (referenced generally) between the first clamping mechanism 14 (and in particular, the gripping surface 62) and the first contact surface 36. In the open position, then, a sheet-like abrasive material 102, and in particular a first end portion 104 thereof, can be inserted within the gap 100 for subsequent securement to the first contact surface 36 via the first clamping mechanism 14.

Of note, since the pivoting member 60 forms the slot 74 with no members extending between the pair of legs 70 other than the transverse surface 80 (FIG. 2), no such members are present to further limit the amount that pivoting member 60 can be pivoted away from the first contact surface 36 (i.e., the amount that the pivoting member 60 can be opened). Accordingly, the clamping mechanism 14 can be opened to define a relatively wide angle θ, which provides additional clearance for a user's fingers (not shown) during loading and unloading of the sheet material from the sanding tool 10. In this way, the wide angle θ increases the ease of loading as well as the general usability of the sanding tool 10.

During use of the sanding tool 10, the first alignment device 18 provides a positive stop surface 112 (described in greater detail below) for facilitating proper placement of the sheet-like abrasive material 102 (FIG. 2) relative to the first end 30 of the base member 12. With continued reference to FIGS. 1 and 3, in one embodiment, the first and second alignment devices 18, 20 are similarly configured such that the following description of the first alignment device 18 equally applies to the second alignment device 20. Alternatively, and as described in greater detail below, the first and second alignment devices 18, 20 can assume different forms; even further, the second alignment device 20 can be eliminated.

In one embodiment, the first alignment device 18 includes a tab 110 extending at least partially between the first contact surface 36 and the first clamping mechanism 14. In particular, with the one embodiment of FIGS. 1 and 3, the tab 110 projects upwardly (relative to an orientation of FIGS. 1 and 3) from the first contact surface 36 toward the first clamping mechanism 14. The tab 110 and the base member 12 can be integrally formed as a unitary body; alternatively, the tab 110 can be separately formed and assembled to the base member 12. Regardless, the tab 110 is longitudinally positioned (relative to a length of the base member 12) between the first end 30 and the pivot point 54. More particularly, the tab 110 defines the stop surface 112 otherwise spaced from the first end 30. The stop surface 112 is positioned forward of the pivot point 54 such that the sheet-like abrasive material 102, otherwise traversing along the first contact surface 36, will interface with the stop surface 112, and thus will not extend to the pivot point 54. Thus, the tab 110, and in particular the stop surface 112, effectively defines a trailing side 114 (referenced generally in FIG. 3) of the gap 100 (i.e., longitudinally opposite an entrance side of the gap 100 generally defined at the first end 30).

In one embodiment, a longitudinal distance between the stop surface 112 and the first end 30 correlates with a length of the base member 12 (i.e., distance between the first and second ends 30, 32), as well as, in some embodiments, with an expected, standardized length of the sheet-like abrasive material 102 intended to be used with the sanding tool 10. In particular, and as described in greater detail below, a longitudinal length between the stop surface 112 and the first end 30 is such that when the sheet-like abrasive material 102 is disposed against the stop surface 112, a sufficient length remains for wrapping about the first end 30, along the bottom surface 34, and into engagement with the second contact surface 38.

As best shown in FIG. 1, the tab 110 is, in one embodiment, laterally offset from opposing sides 116, 118 of the first contact surface 36. For example, the tab 110 can be laterally centered relative to the opposing sides 116, 118 (i.e., relative to a width of the first contact surface 36). This one preferred location increases a likelihood that during an abrasive sheet loading operation, the stop surface 112 will be contacted by the sheet-like abrasive material 102 (FIG. 2). Alternatively, other locations are also acceptable as described below.

In one embodiment, the first clamping mechanism 14 is configured to accommodate the tab 110 in the closed position (shown in FIG. 2). For example, the pivoting member 60 forms an aperture 120 sized and positioned such that upon final assembly, the aperture 120 is aligned with the tab 110 and permits passage of the tab 110 through the aperture 120 as the pivoting member 60 transitions from the open position to the closed position. Alternatively, projection of the tab 110 from the first contact surface 36 can be reduced from that shown in FIGS. 1–3, such that the aperture 120 need not be included. Preferably, however, the tab 110 is of a fairly significant height so as to ensure interface with the sheet-like abrasive material 102 (FIG. 2) otherwise being loaded to the first contact surface 36.

The tab 110 further forms, in one embodiment, a portion of a locking mechanism 130 (referenced generally in FIG. 1) that selectively locks or secures the first clamping mechanism 14 in the closed position (i.e., shown for the second clamping mechanism 16). In particular, the locking mechanism 130 includes, in one embodiment, the tab 110, the aperture 120, and an engagement surface 132. To this end, and with reference to FIG. 3 the tab 110 is formed to include a finger 134, which otherwise forms the stop surface 112 and a latch body 136. The latch body 136 extends from the finger 134 opposite the contact surface 36, preferably in a direction away from the first end 30.

The engagement surface 132 is defined at a perimeter of the aperture 120. Referring to FIG. 2, in one embodiment, the engagement surface 132 is formed with a ramp member 140 extending from a contoured surface 142 of the pivoting member 60, which has a substantially curvilinear or other suitable contour. In this manner, the ramp member 140 is configured to form the engagement surface 132 as a substantially planar surface for receiving the latch body 136 regardless of the contour of the pivoting member 60. With this configuration, in the closed position, the finger 134 extends through the aperture 120, with the latch body 136 abutting against the substantially planar engagement surface 132, such that the tab 110 secures the first clamping mechanism 14 relative to the base member 12. In one example, the substantially planar formation of the engagement surface 132 permits the latch body 136 to contact the engagement surface over a larger contact area than would otherwise be realized, thereby, more reliably securing the clamping mechanism 14 relative to the base member 12. In one embodiment, the substantially planar engagement surface 132 further permits the contoured surface 142 to be formed in a shallower manner.

In one embodiment, to facilitate passage of the latch body 136 through the aperture 120 as the pivoting member 60 transitions from the open position to the closed position, as well as to permit selective disengagement of the latch body 136 from the engagement surface 132, the tab 110 can be slightly deflectable from the upright orientation illustrated in FIG. 1. With this construction, then, the latch body 136 can be forced slightly toward the first end 30, via deflection of the finger 134, to permit passage through the aperture 120. Alternatively, the locking mechanism 130 can assume a variety of other forms, and need not be identical relative to the first and second clamping mechanisms 14, 16. In some embodiments, a locking mechanism is not provided for one or both of the clamping mechanisms 14 and/or 16.

While the first alignment device 18 has been described as including the tab 110, other configurations can be employed, several examples of which are provided below. For example, the stop surface 112 can be defined by one or more other structures that may or may not be tabs (e.g., a continuous or discontinuous bump or flange). Regardless, the first alignment device 18 is configured to provide the stop surface 112 as defining the trailing side 114 of the gap 100 for assisting in proper positioning of the sheet-like abrasive material 102 relative to the first end 30 as part of a loading operation described below.

With specific reference to FIG. 3, loading of the sheet-like abrasive material 102 to the tool 10 begins with transitioning of the first clamping mechanism 14 to an open position such that the gap 100 is formed. The first end portion 104 of the sheet-like abrasive material 102 (otherwise terminating at an edge 150) is manually inserted by a user (not shown) into the gap 100. In particular, with the first clamping mechanism 14 in the open position, the first end portion 104 is inserted into the gap 100 at or about the first end 30 and positioned along the first contact surface 36. In this regard, the first end portion 104 is maneuvered or directed within the gap 100 (i.e., away from the first end 30) until the edge 150 contacts or abuts against the stop surface 112 provided by the tab 110. Further movement of the edge 150 beyond the stop surface 112 (i.e., closer to the pivot point 54) is thus impeded, ensuring that a desired length of the sheet-like abrasive material 102 is within the gap 100 and that the edge 150 will not interfere with subsequent movement of the clamping mechanism 14 at the pivot point 54.

With the first end portion 104 properly located within the gap 100, the first clamping mechanism 14 is then transitioned (e.g., rotated) to a closed position as shown in FIG. 4. As the clamping mechanism 14 is urged toward the contact surface 36, the tensioning member 64 further grips the first end portion 104 of the abrasive material 102 and deflects to move the first end portion 104 upwardly along the inclined contact surface 36 and thus away from the associated end 30. This action draws the sheet of abrasive material 102 further into the gap 100.

In the closed position, the gripping surface 62 engages the sheet-like abrasive material 102, frictionally capturing the first end portion 104 between the gripping surface 62 and the first contact surface 36. Thereby, the first end portion 104 is secured to the sanding tool 10, with a remainder 152 (reference generally) of the sheet-like abrasive material 102 freely extending from the first end 30 of the base member 12. When the sheet-like abrasive material 102 is held between the gripping surface 62 and the first contact surface 36, the sheet-like abrasive material 102 also interfaces with the point(s) 42 of the one or more teeth 40 (FIG. 3) extending upwardly from the first contact surface 36. In one embodiment, the sheet-like abrasive material 102 is further pinched between the teeth 40 and the gripping surface 62 to more robustly secure the sheet-like abrasive material 102 in place in the sanding tool 10.

Continuing to refer to FIG. 4, in one embodiment, upon closure of the first clamping mechanism 14, the at least one tooth 40 is configured to align or correspond with an indention 153 defined by the gripping surface 62. As such, the sheet-like abrasive material 102 is pinched between each tooth 40 and the gripping surface 62 to position the sheet-like abrasive material 102 in a compound bend or curve, which is generally referenced at 160. The compound bend 160 of the sheet-like abrasive material 102 is formed when the sheet-like abrasive material 102 bends in a first direction followed by a bend in a second direction that is different from the first direction. The compound bend 160 is longitudinally oriented relative to a length of the base member 12. The compound bend 160 creates a tortuous path for the release of the sheet-like abrasive material 102 form the sanding tool 10, thereby preventing or at least substantially decreasing the likelihood that the sheet-like abrasive material 102 will unintentionally be dislodged from between the gripping surface 62 and the first contact surface 36 during use or due to other commonly applied tensile forces. As such, to remove the sheet-like abrasive material 102 from the sanding tool 10, the first clamping mechanism 14 would generally be unlocked and pivoted away from the first contact surface 36 to release the sheet-like abrasive material 102.

Figure 5:
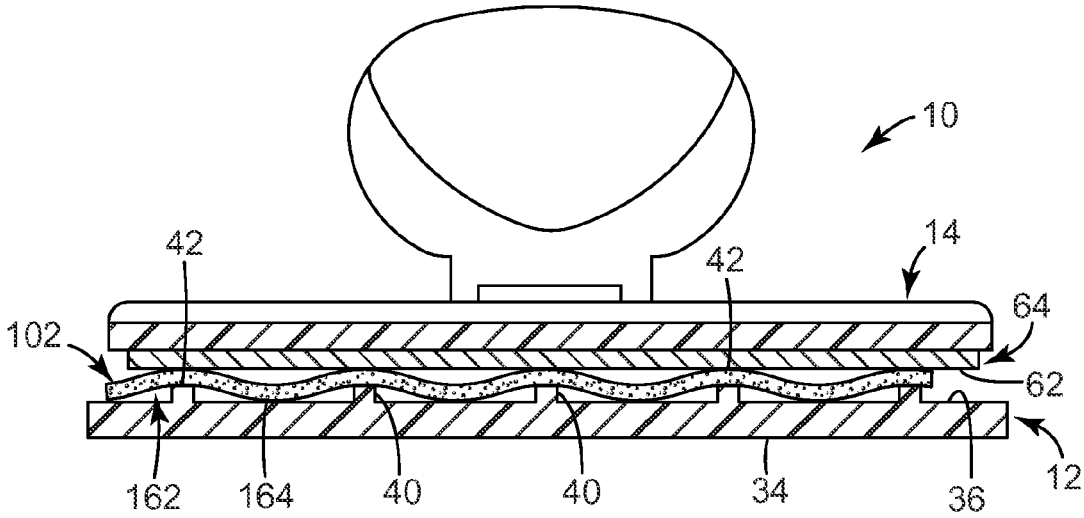
FIG. 5 is a cross-sectional view of FIG. 4 taken along the line 5—5.

Referring to the cross-sectional view of FIG. 5, in one embodiment, a plurality of teeth 40 are spaced along the first end 30 of the sanding tool 10 and are sufficiently laterally spaced from one another to create a laterally orientated compound bend or curve generally indicated at 162 as the sheet-like abrasive material 102 is forced to bend around each tooth 40. More specifically, the teeth 40 are spaced to prevent "bridging" of the sheet-like abrasive material 102 between the teeth 40, wherein the sheet-like abrasive material 102 would extend straight across the teeth points 42 without curving down (relative to the orientation of FIG. 5) to define valleys 164 therebetween. The compound curvature 162 of the sheet-like abrasive material 102 laterally between and over the teeth 40 further bolsters securement of the sheet-like abrasive material 102 by the sanding tool 10, which, consequently, also serves to prevent or at least substantially decrease the likelihood that the sheet-like abrasive material 102 will unintentionally be dislodged from between the gripping surface 62 and the first contact surface 36 during use or other commonly applied tensile force.

In one embodiment, the teeth 40 may partially or fully penetrate or otherwise hook into the sheet-like abrasive material 102 to more effectively lock the sheet-like abrasive material 102 in place relative to the first contact surface 36. Accordingly, the teeth 40 facilitate securement of the sheet-like abrasive material 102 between the first contact surface 36 and the gripping surface 62 even when a force of tension is applied to the sheet-like abrasive material 102 that could otherwise pull the sheet-like abrasive material 102 out of gap 100 and away from the first end 30. In particular, the teeth 40 facilitate securement of any form of the sheet-like abrasive material 102, such as conventional sandpaper, flexible sanding scrims, non-woven abrasive materials such as Scotch-Brite™ available from 3M Company, St. Paul, Minn., and thin flexible abrasive sheet materials such as those described in U.S. Pat. No. 6,613,113, which was mentioned above.

Figure 6:
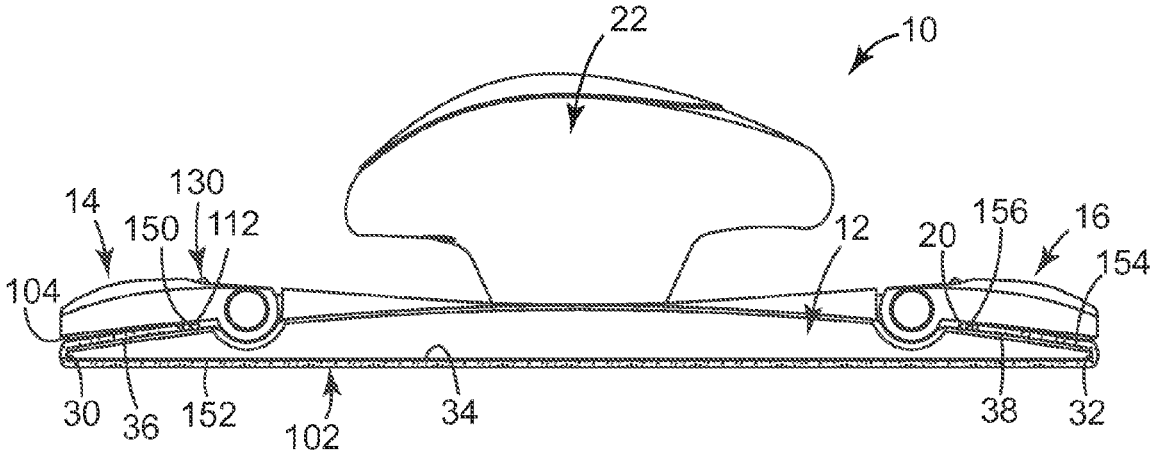
FIG. 6 is a side view of the tool of FIG. 1 loaded with a sheet-like abrasive material.

With reference to FIG. 6, once the first end portion 104 of the sheet-like abrasive material 102 is secured relative to the first contact surface 36, the remainder 152 of the sheet-like abrasive material 102 is wrapped about the first end 30, along the bottom surface 34, and directed toward the second end 32. A second end portion 154 of the sheet-like abrasive material 102 is then secured to the second contact surface 38, for example via the second clamping mechanism 16 in a manner similar to that previously described with respect to operation of the first clamping mechanism 14. While an edge 156 defined by the second end portion 154 is shown in FIG. 6 as approximately contacting the second alignment device 20, this relationship is not required. That is to say, securement of the second end portion 154 to the tool 10 can be accomplished independent of an exact length of material actually extending along the second contact surface 38. Regardless, a user is able to tension the sheet-like abrasive material 102 about the bottom surface 34 (i.e., because the first end portion 104 is secured to the tool 10, the user can "pull" on the remainder 152 while wrapping), resulting in a tight, tensioned fit.

Although described as forcing the sheet-like abrasive material to form one or more of a lateral or longitudinally oriented compound bend, in one embodiment, in which a thin flexible abrasive sheet materials such as those described in U.S. Pat. No. 6,613,113 (Minick et al.) are used, the teeth 40 may alternatively or additionally fit within voids of the abrasive sheet material, thereby, grasping the sheet-like abrasive material to once again prevent unintentional dislodgement of the sheet-like abrasive material during use.

In view of the above, the first alignment device 18 allows a user to employ the above-described sequential loading technique, confident that following securement of the first end portion 104, the remainder 152 (FIG. 4) is of sufficient length to "reach" the second end 32. This is especially applicable to instances in which the sheet-like abrasive material 102 used with the sanding tool 10 is an off-the-shelf product having a standardized length. For example, but in no way limiting, sheet-like abrasive materials are commonly sold having a length of 9 inches (either full size sheets (e.g., 9 inch×11 inch) that a user (not shown) can tear to a desired width, or partial size sheets having a decreased width). Regardless, with this standardized length in mind, a longitudinal location of the stop surface 112 relative to the first end 30 is selected to ensure that a sufficient length of the sheet-like abrasive material 102 (i.e., the remainder 152 described with reference to FIG. 4) is available for wrapping about the bottom surface 34 and engagement with the second contact surface 38 (e.g., via the second clamping mechanism 16). That is to say, appropriate loading of a standardized length of sheet-like abrasive material 102 can be consistently achieved by initially locating the edge 150 against the stop surface 112; the user is then assured that enough length remains for attachment to the second contact surface 38.

In one embodiment, in the closed position, the locking mechanism 130 (referenced generally in FIG. 6) operates to secure the first clamping mechanism 14 relative to the base member 12, thus preventing unintentional dislodgement of the first end portion 104 from the sanding tool 10. In one embodiment, the planar configuration of the engagement surface 132 allows the first clamping mechanism 14 to be more effectively locked in the closed position. In one embodiment, the second clamping mechanism 16 is also locked in a closed position via a separate locking mechanism.

While the sanding tool 10 has been described as forming the first and second alignment devices 18, 20 to each include a single tab (i.e., the tab 110) that is otherwise laterally centered relative to a width of the corresponding contact surface, in alternative embodiments, two or more tabs can be employed. Although tab 110 is described above as projecting from the first contact surface 36, in one embodiment, one or more tabs can alternatively or additionally be included that project from the corresponding clamping mechanism 14 or 16. For example, the tab 110 of FIG. 1 can project from the first clamping mechanism 14 (e.g., integrally formed with the pivoting member 60 as a unitary body).

Figure 7:
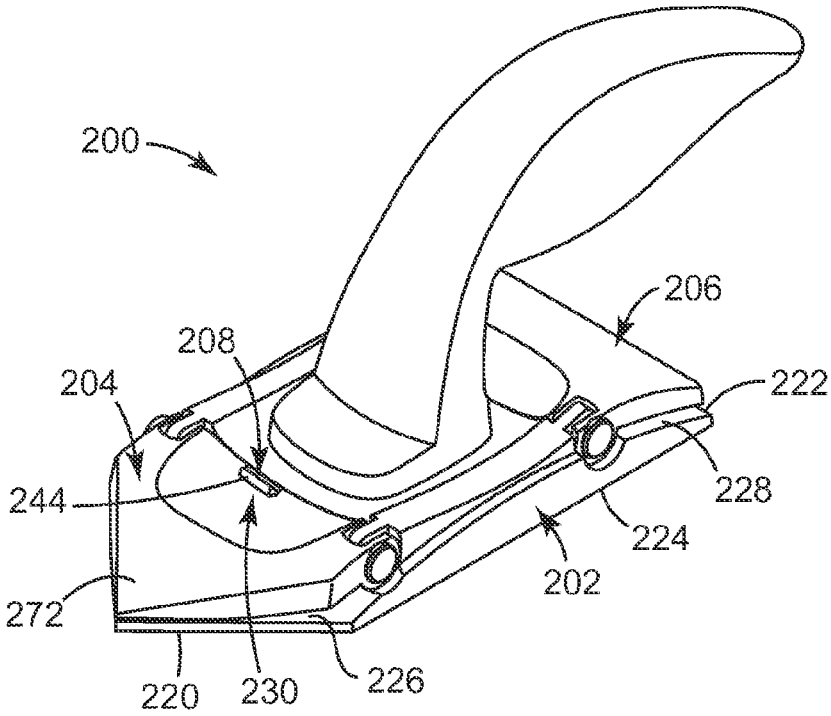
FIG. 7 is a perspective view of another embodiment hand-held, manually operated sanding tool according to principles of the present invention.

Another embodiment of a sanding tool 200 in accordance with principles of the present invention is shown in FIG. 7. The sanding tool 200 includes a base member 202, first and second clamping mechanisms 204, 206, and a first alignment device 208 (referenced generally). The base member 202 defines first and second ends 220, 222, a bottom surface 224 (referenced generally), and first and second upper contact surfaces 226, 228 (referenced generally). In one embodiment, the clamping mechanisms 204 and 206 are similar to the clamping mechanisms 14 and 16 (FIG. 1) described above and respectively interact with the base member 202 in a manner similar to the interaction between the clamping mechanisms 14 and 16 and the base member 12 (FIG. 1) as described above except where explicitly differentiated herein. The bottom surface 224 is generally planar. A sheet-like abrasive material (not shown) is configured to extend from around the first end 220 across the bottom surface 224 and around the second end 222.

Unlike previous embodiments, the first end 220 defines a triangular-like shape, with the first clamping mechanism 204, and in particular, a pivoting member 230 thereof, defining a similar shape. The alignment device 208 is similar to the alignment device 18 (FIG. 1) previously described, and forms a portion of a locking mechanism 230 (referenced generally). The second clamping mechanism 206 is, in one embodiment, similar to the clamping mechanism 14 described above, but alternatively can assume a variety of other forms such as a conventional mechanism for securing a sheet-like abrasive material to the base member 202.

Figure 8:
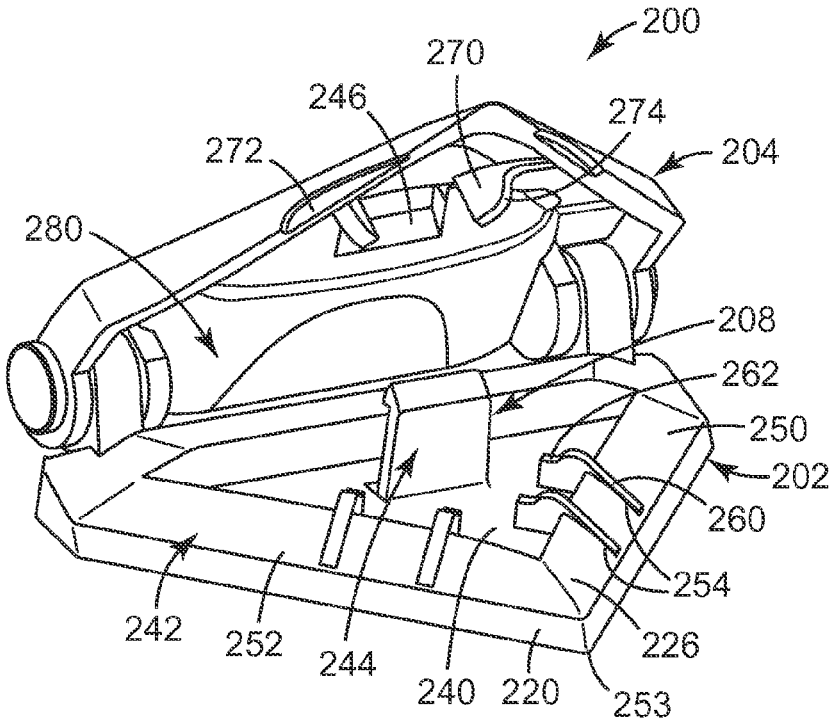
FIG. 8 is another perspective view of a portion of the sanding tool of FIG. 7 with the clamping mechanism in an open position.

FIG. 8 illustrates an enlarged, perspective view of a portion of the sanding tool 200 of FIG. 7. Referring to FIGS. 7 and 8, in one embodiment, the base member 202 defines a recessed portion 240 and a perimeter portion 242 extending at least partially around the recessed portion 240. A tab 244, which is similar to the tab 110 described above, extends upwardly (relative to the illustrated orientation of FIGS. 7 and 8) from the recessed portion 240 and is configured to fit through an aperture 246 of the first clamping mechanism 204 to lock the first clamping mechanism 204 in a closed position. In one embodiment, the tab 244 is laterally centered on the base member 202 (relative to a length of the base member 202).

Due to the triangular-like shape of the first end 220, the perimeter portion 242 defines a first end segment 250 and a second end segment 252, which each extend back from a front point 253 of the first end 220 (relative the orientation of FIG. 7). Each end segment 250, 252 is essentially ramped to extend with an increasingly upward progression from the bottom surface 224 to facilitate manipulation of the sheet-like abrasive material (not shown) to be locked between the base member 202 and the first clamping mechanism 204. In one embodiment, at least one of the teeth 254 extends at least partially upwardly from and is spaced along each of the end segments 250, 252. In one embodiment, each tooth 254 partially extends from each of the respective end segment 250, 252 and the recessed portion 240. As illustrated, each of the teeth 254 also may be formed as a ramp, which extends increasingly upwardly as the tooth 254 extends increasingly away from the first end 220. In one embodiment, each ramp 254 defines a surface 260 to interact with the sheet-like abrasive material having a depressed portion 262 opposite the first end 220. However, other suitably formed teeth 254 are equally acceptable.

In one embodiment, the first clamping mechanism 204 does not include the tensioning member 64 (FIG. 1) described above. Rather, the first clamping mechanism 204 defines at least one protrusion 270 extending from a front section 272 thereof toward the base member 202. In one embodiment, the at least one protrusion 270 is set back from a front edge of the first clamping mechanism 204 and defines a surface 274 opposite the front section 272. In one embodiment, one protrusion 270 is positioned to be substantially centered between two of the teeth 254 along each of the end segments 250, 252 when the clamping mechanism 204 is in a closed position.

Upon assembly, the first clamping mechanism 204 is rotatably connected to the base member 202 in a manner similar to that described above with respect to the sanding tool 10 (FIG. 1). When the first clamping mechanism 204 is in an open position, a gap 280 (referenced generally) is formed to receive a sheet-like abrasive material (not shown for clarity). More specifically, the sheet-like abrasive material is positioned to interface with the tab 244, which provides a positive stop preventing undesired advancement of the sheet-like abrasive material further into the gap 280.

Once the sheet-like abrasive material is positioned, the first clamping mechanism 204 is transitioned to a closed position, or more particularly, is pivoted toward the base member 202. As the first clamping mechanism 204 is urged toward the contact surface 226, the sheet-like abrasive material is pinched between the at least one tooth 254 and the at least one protrusion 270. Further movement of the first clamping mechanism 204 causes the tab 244 to engage the first clamping mechanism 204 through the aperture 246 to lock the first clamping mechanism 204 in a closed position as illustrated with additional reference to FIG. 7. When in the closed position, the sheet-like abrasive material is clamped between the teeth 254 and the protrusion 270, more specifically, between the surfaces 260, 274 thereof. In one embodiment, the teeth 254 and the protrusion 270 collectively force the sheet-like abrasive material to form a compound bend in a similar manner as described above with respect to FIGS. 4 and 5. Accordingly, a tortuous path is created for the sheet-like abrasive material, thereby, substantially preventing or at least decreasing the likelihood of the sheet-like material undesirably being dislodged from between the first contact surface 226 and the first clamping mechanism 204 during use.

The sanding tool in accordance with principles of the present invention provides a marked improvement over previous designs. Moreover, the teeth and/or protrusions permit the sheet-like abrasive material to be manipulated into a compound bend to bolster securement of the sheet-like abrasive material between the base member and the clamping mechanism, thereby decreasing the likelihood that the sheet-like abrasive material will be unintentionally dislodged therefrom. The pivot connection between the base member and the clamping mechanism is also configured to provide a wide opening angle therebetween to increase the overall ease of using the sanding tool Furthermore, the substantially planar engagement surface bolsters the functionality of the tab to lock the clamping mechanism relative the base member and provides an opportunity for various contours to be used to define the clamping mechanism. As such, at least these features each provide improvements over prior art designs.

Although specific embodiments have been illustrated and described herein, it will be appreciated by those of ordinary skill in the art that a variety of alternate and/or equivalent implementations may be substituted for the specific embodiments shown and described without departing from the scope of the present invention. For example, the various features described with respect either one of the sanding tools 10, 200 may be interchanged with or added to the features of the other one of the sanding tools 10, 200, etc. This application is intended to cover any adaptations or variations of the specific embodiments discussed herein. Therefore, it is intended that this invention be limited only by the claims and the equivalents thereof.

What is claimed is:

1. A hand-held, manually-operated sanding tool for use with a replaceable sheet of abrasive material, the sanding tool comprising:

a base member defining first and second ends, a bottom surface extending between the first and second ends, a contact surface formed opposite the bottom surface and extending from the first end, and at least one tooth extending from the contact surface; and a clamping mechanism pivotally connected to the base member at a pivot point, the clamping mechanism defining a front section opposite the pivot point;

wherein the clamping mechanism is movable about the pivot point between an open position, in which the front section is spaced from the contact surface to establish a gap between the clamping mechanism and the contact surface for receiving an end portion of a sheet of abrasive material, and a closed position, in which the clamping mechanism is more proximate the contact surface and in which the front section is more proximate the at least one tooth than when the clamping mechanism is in the open position.

2. The sanding tool of claim 1, wherein when in the closed position, the sanding tool is configured to pinch and maintain the end portion of the sheet of abrasive material between the at least one tooth and the clamping mechanism.

3. The sanding tool of claim 1, wherein the clamping mechanism includes a pivoting member connected to the base member and a tensioning member coupled with the pivoting member opposite the pivot point, and further wherein the tensioning member defines a gripping surface such that, in the closed position, a first portion of the sheet of abrasive material is clamped between the gripping surface and the contact surface.

4. The sanding tool of claim 3, wherein the gripping surface includes an indentation configured to align with the at least one tooth when the clamping mechanism is in the closed position.

5. The sanding tool of claim 3, wherein the tensioning member includes a leaf spring configured to lock the end portion of the sheet of abrasive material in place relative to the contact surface during use when the clamping mechanism is in a closed position.

6. The sanding tool of claim 1, wherein the at least one tooth is a plurality of teeth laterally spaced along the contact surface.

7. The sanding tool of claim 6, wherein the plurality of teeth are spaced apart a distance sufficient to prevent bridging of the sheet of abrasive material over the plurality of teeth when the clamping mechanism is in the closed position.

8. The sanding tool of claim 6, wherein in the closed position, the clamping mechanism and the plurality of teeth are configured to interact with the sheet of abrasive material such that the sheet of abrasive material is manipulated to form a laterally orientated compound bend to lock the sheet of abrasive material in place.

9. The sanding tool of claim 6, wherein in the closed position, the clamping mechanism and the plurality of teeth are configured to interact with the sheet of abrasive material such that the sheet of abrasive material is manipulated to form a longitudinally orientated compound bend to lock the sheet of abrasive material in place.

10. The sanding tool of claim 1, wherein at least one protrusion extends from the front section of the clamping mechanism toward the contact surface.

11. The sanding tool of claim 8, wherein the at least one protrusion and the at least one tooth are configured to form a compound bend in the end portion of the sheet of abrasive material during use when the clamping mechanism is in the closed position.

12. The sanding tool of claim 1, wherein the at least one tooth defines a ramped surface extending increasingly further away from the contact surface as the at least one tooth extends nearer to the pivot point.

13. The sanding tool of claim 1, wherein the base member includes a tab extending from the contact surface away from the bottom surface, the tab being configured to selectively interface with the clamping mechanism to lock the clamping mechanism in the closed position.

14. The sanding tool of claim 13, wherein the tab defines a latch body, and the clamping mechanism defines a substantially planar engagement surface configured to selectively receive the latch body to lock the clamping mechanism in the closed position.

15. The sanding tool of claim 1, wherein the base member defines a post, and the clamping mechanism defines a pair of legs defining a slot, wherein the post is pivotally coupled within the slot to define the pivot point.

16. The sanding tool of claim 15, wherein an open angle is defined within the gap between the contact surface and the clamping mechanism of greater than about 60°when the clamping mechanism is in the open position.

17. A method of sanding with a hand-held, manually operated sanding tool, the method comprising:

providing a sanding tool including:

a base member defining first and second ends, a bottom surface extending between the first and second ends, a contact surface formed opposite the bottom surface and extending from the first end, and at least one tooth extending from the contact surface, and a clamping mechanism pivotally connected to the base member at a pivot point, the clamping mechanism defining a front section opposite the pivot point;

positioning the clamping mechanism in an open position, in which the front section is spaced from the first contact surface to establish a gap between the clamping mechanism and the contact surface;

placing a replaceable sheet-like abrasive material within the gap;

moving the clamping mechanism about the pivot point from the open position to a closed position to clamp a first portion of the sheet-like abrasive material between the clamping mechanism and the contact surface; and locking the clamping mechanism in the closed position to maintain the sheet-like abrasive material between the clamping mechanism and the contact surface.

18. The method of claim 17, wherein locking the clamping mechanism in the closed position includes forcing the sheet-like abrasive material to form a compound bend between the clamping mechanism and the contact surface.

19. The method of claim 17, wherein positioning the clamping mechanism in an open position includes pivoting the clamping mechanism about the pivot point to define an angle between the clamping mechanism and the contact surface greater than about 60°.

20. The method of claim 17, wherein the base member includes a tab forming a latch member opposite a remainder of the base member, and the clamping mechanism defines an aperture and an engagement surface adjacent the aperture, further wherein locking the clamping mechanism includes moving the latch member through the aperture to interface with the engagement surface.

* * * * *